US007740143B2

(12) United States Patent
White

(10) Patent No.: US 7,740,143 B2
(45) Date of Patent: Jun. 22, 2010

(54) PORTABLE SPORTS EQUIPMENT RACK

(76) Inventor: Thomas White, 8932 Lamon, Apt. 2, Skokie, IL (US) 60077

( * ) Notice: Subject to any disclaimer, the term of this patent is extended or adjusted under 35 U.S.C. 154(b) by 360 days.

(21) Appl. No.: 11/800,570

(22) Filed: May 7, 2007

(65) Prior Publication Data

US 2008/0277362 A1 Nov. 13, 2008

(51) Int. Cl.
*A47F 7/00* (2006.01)

(52) U.S. Cl. ..... 211/85.7

(58) Field of Classification Search ..... 211/85.7, 211/86.01, 113, 70.6, 89.01, 195; 206/315.1, 206/315.9, 315.11, 747, 745, 736; 220/4.27, 220/4.26, 4.33, 4.29, 4.28, 23.4, 23.2
See application file for complete search history.

(56) References Cited

U.S. PATENT DOCUMENTS 316,062 A * 4/1885 Riessner ..... 211/65
1,188,791 A * 6/1916 Knechtel ..... 211/70.6
1,318,007 A * 10/1919 Gau ..... 312/244
3,650,407 A 3/1972 Benham Jr.
3,698,563 A * 10/1972 Gordon et al. ..... 211/85.7
4,049,126 A * 9/1977 Halverson ..... 211/104
4,193,495 A * 3/1980 Keeley ..... 294/143
4,227,710 A 10/1980 Laub
4,583,647 A 4/1986 Schinzing
4,629,065 A * 12/1986 Braaten ..... 206/315.1
4,693,402 A 9/1987 Comeau
4,807,763 A 2/1989 Jankovsky
4,854,456 A 8/1989 Lee
4,890,731 A * 1/1990 Mroz ..... 206/315.9
4,968,048 A 11/1990 Lortie
5,085,327 A 2/1992 Mercer, Jr. et al.
D335,416 S * 5/1993 Shaw ..... D6/552
5,209,539 A * 5/1993 Atalay ..... 294/143
5,224,602 A * 7/1993 Bettles et al. ..... 206/579
5,337,907 A 8/1994 McKenzie et al.
D373,498 S 9/1996 Young
D377,572 S 1/1997 Martin
5,690,235 A 11/1997 Matzen
5,695,067 A * 12/1997 Harvey ..... 206/579
5,845,780 A 12/1998 Allen
5,871,105 A 2/1999 Whitehead et al.
5,890,605 A * 4/1999 Percudani ..... 211/87.01
5,895,085 A 4/1999 Miller, Jr.
D417,113 S 11/1999 Greaney et al.
5,975,293 A 11/1999 Fowler (Continued)

*Primary Examiner*—Janet M Wilkens
*Assistant Examiner*—Dan Rohrhoff
(74) *Attorney, Agent, or Firm*—Greenberg Traurig LLP

(57) ABSTRACT

A portable sports equipment rack is provided with two relatively foldable sections. Each section has a top wall and a bottom wall below the top wall. End walls and a rear wall hold the top and bottom walls vertically spaced. Along the front edge of at least one of the bottom walls are located a number of handle receiving structures. At least one hinge joins adjacent end edges of the bottom walls. When the portable sports equipment rack is suspended, chiefly by its ends, the weight of the rack will tend to keep it in an open deployed configuration. The sections can be folded against one another, and held together by a latch. A handle on one of the top walls facilitates carrying of the rack when it is folded. A further embodiment of the sports equipment rack is formed from an assembly of modules, each containing a top wall, bottom wall, sidewalls, rear wall, and handle receiving structures.

8 Claims, 11 Drawing Sheets

U.S. PATENT DOCUMENTS 6,196,217 B1 3/2001 Smith
6,222,159 B1 4/2001 Healy
6,494,468 B1 12/2002 Inge
6,749,074 B1 * 6/2004 Hileman et al. ..... 211/85.7
7,322,149 B1 * 1/2008 Quintero ..... 43/26
2005/0274637 A1 * 12/2005 Chen ..... 206/315.1
2006/0144806 A1 * 7/2006 Joannou ..... 211/85.7

* cited by examiner

PORTABLE SPORTS EQUIPMENT RACK

BACKGROUND OF THE INVENTION

1. The Technical Field

The present invention is directed to racks and supports for sports equipment, and in particular, to racks for supporting and organizing baseball equipment, particularly for use in baseball dugouts and areas thereabouts. The rack may also be used for other equipment, such as hockey equipment.

2. The Prior Art

Racks for the support, display and/or storage of sports equipment, in particular baseball equipment, are known. Examples of such racks include the following references:

Benham, Jr., U.S. Pat. No. 3,650,407 discloses a fixed, single piece rack, for holding a small number of bats in notches that are immediately adjacent a back mounting wall. A shallow, dished upper area serves to hold balls.

Gordon et al., U.S. Pat. No. 3,698,563 discloses an elongated equipment storage rack having an elongated trough, immediately in front of which are notches for holding bats. The vertically extending front wall of the trough is positioned close to the inner ends of the notches. Extending upwardly from the rear wall of the trough are angled flat fingers, for holding helmets or gloves.

Halverson, U.S. Pat. No. 4,049,126 discloses a foldable bat rack, that comprises a single level, in two sections connected by a horizontally extending hinge on a lower side of the joint. No storage space is provided behind the notches for receiving the bat ends.

Keeley, U.S. Pat. No. 4,193,495 discloses a bat and helmet rack, in two sections that are foldably connected about a vertically extending hinge. Spring clips are mounted to vertical planar members to form each section. When folded the clips face outwardly, to permit the rack to be carried with the equipment still in place. Handles emanate from the top edges of the two planar members, and align with one another when the rack is folded.

Laub, U.S. Pat. No. 4,227,710 discloses a rolling cart configured for holding bats (vertically), helmets, and a supply of baseballs.

Schinzing, U.S. Pat. No. 4,583,647 discloses a fixed, wall mounted, cantilevered single level bat rack.

Braaten, U.S. Pat. No. 4,629,065 discloses a baseball equipment holder, formed from a tubular housing having cutouts defining various hooks (for helmets or gloves) or notches (for bats).

Comeau, U.S. Pat. No. 4,693,402 discloses a baseball equipment holding backpack.

Jankovsky, U.S. Pat. No. 4,807,763 discloses a freestanding baseball bat stand.

Lee, U.S. Pat. No. 4,854,456 discloses a fixed rack having notches on opposite ends for holding bats, skis, etc., and racks in between formed by parallel extending rods, for holding balls of various diameters (basketballs vs. baseballs, etc.).

Mroz, U.S. Pat. No. 4,890,731 discloses a suitcase-shaped baseball equipment carrier in the form of a frame without sidewalls.

Lorie, U.S. Pat. No. 4,968,048 discloses a wheeled baseball equipment cart.

Mercer, Jr. et al., U.S. Pat. No. 5,085,327 discloses a freestanding sports equipment organizer.

Shaw, U.S. Des. 335,416 discloses a design for an ornamental appearance for a hanging baseball equipment storage and organizer case, having six cells for holding helmets, in two rows of three, and a lower level of notches for holding bats.

McKenzie et al., U.S. Pat. No. 5,337,907 discloses a fabric based holder for beverage bottles, configured to be hung on a chain link fence.

Young, U.S. Des. 373,498 discloses a board-based storage device with fork-shaped projections for holding bats, along the bottom edge thereof.

Martin, U.S. Des. 377,572 discloses a bat and helmet rack that is formed from a number parallel rods connected by flexible straps.

Matzen, U.S. Pat. No. 5,690,235 discloses a bat hanger in the form of a tube that has cutouts defining notches for holding the ends of bats. Indentations on the top of the tube can hold balls. Hooks are provided for hanging the tube on a fence.

Allen, U.S. Pat. No. 5,845,780 discloses a suitcase-style bag for holding athletic equipment.

Whitehead et al., U.S. Pat. No. 5,871,105 discloses a frame-style rack for holding miscellaneous sports equipment having a lowermost solid transverse shelf, and other support areas formed by parallel bars.

Miller, Jr., U.S. Pat. No. 5,895,085 discloses a helmet carrying and hanger assembly in the form of a single transverse rod, having a number of upwardly extending pegs, and a central T-shaped handle.

Fowler, U.S. Pat. No. 5,975,293 discloses a suitcase-style bag for holding athletic equipment.

Greaney et al., U.S. Des. 417,113 discloses a design for an ornamental rack in the shape of a baseball diamond, configured to hold two hats or helmets, a bat and a ball.

Smith, U.S. Pat. No. 6,196,217 B1 discloses a solar powered bat warmer, in the shape of a box having a transparent front and openings in the top, into which bats are inserted.

Healy, U.S. Pat. No. 6,222,159 B1 discloses a bat warmer using a convection thermal heat source. The cabinet is in the form of an upright, wheeled, box having a heat source in the bottom.

Inge, U.S. Pat. No. 6,494,468 B1 discloses a wagon like sports equipment storage device, having a large open box area, and a rack for holding ball bats upright.

It would be desirable to provide a sports equipment rack, particularly one for baseball, which is capable of carrying a large quantity of different pieces of equipment, yet is highly portable and/or reducible to a compact form.

It would also be desirable to provide a sports equipment rack, particularly a baseball equipment rack, which is configured to be suspended from a vertical support, such as a chain-link backstop.

These and other desirable characteristics of the present invention will become apparent in view of the present specification, including claims, and drawings.

SUMMARY OF THE INVENTION

The present invention is directed, in part, to a portable equipment rack, for supporting and organizing equipment, particularly sports equipment. The portable equipment rack comprises first and second equipment supporting sections. Each equipment supporting section includes a top wall, a bottom wall vertically spaced from the top wall, a rear wall extending between the top and bottom walls and connected to rear edges of the top and bottom walls, and two end walls extending between the top and bottom walls and along the edges of the rear wall and connected to respective end edges of the top and bottom walls.

At least one bottom wall of the first and second equipment supporting sections preferably has at least one handle receiving structure disposed along a front edge region thereof. The at least one bottom wall further has an equipment receiving surface disposed between the handle receiving structure, and the rear edge of the at least one bottom wall.

A hinge preferably is mounted to adjacent end edge regions of the respective bottom walls of the first and second equipment supporting sections, so that an end wall of each equipment supporting section is disposed proximate the hinge and the other end wall of each supporting section is disposed distal to the hinge.

The hinge further preferably has an axis of pivoting that extends parallel to adjacent end edges of the respective bottom walls of the first and second equipment supporting sections, for enabling the first and second equipment supporting sections to be pivoted between a deployed configuration, in which the first and second equipment supporting sections are disposed end-to-end, and a stowed configuration, in which the first and second equipment supporting sections are pivoted such that the respective bottom walls are juxtaposed parallel and adjacent one another.

The positioning of the hinge preferably is such that when the equipment rack is supported by its ends in the deployed configuration, the weight of the respective first and second equipment supporting sections will tend to prompt the first and second equipment supporting sections toward pivoting upwardly relative to one another, prompting end edge regions of the top walls toward one another, to maintain the equipment rack in its deployed configuration.

In a preferred embodiment of the invention, the at least one handle receiving structure comprises a baseball bat handle receiving notch formed in a front edge region of the at least one bottom wall of the first and second equipment supporting sections, the equipment receiving surface being disposed between an innermost extremity of the bat handle receiving notch and the rear edge of the at least one bottom wall. In an alternative embodiment of the invention, the at least one handle receiving structure comprises at least one resilient biased structure, disposed along the front edge region of the at least one bottom wall of the first and second equipment supporting sections, and operably configured to resistively yield and resiliently, yet releasably retain, a sports equipment handle, when the sports equipment handle is forcibly inserted into the at least one resilient biased structure.

Preferably, the equipment rack further comprises latching structures, disposed on the end walls of the first and second equipment supporting sections distal to the hinge, for releasably maintaining the first and second equipment supporting sections in the stowed configuration, for facilitating transportation of the equipment rack between uses.

The equipment rack may further comprise a handle disposed on an outer surface of one of the top walls of the first and second equipment supporting sections, for facilitating carrying of the equipment rack when in its stowed configuration.

At least one hanging device is preferably provided for enabling the equipment rack to be suspended from a vertical support structure. The at least one hanging device preferably comprises a hook, connected by an elongated flexible member, to an outer surface of each of the end walls of the first and second equipment supporting sections that are disposed distal to the hinge; and at least one second hook, connected substantially directly to an outer surface of one of the rear walls of the first and second equipment supporting sections.

The top wall of one of the first and second equipment supporting sections preferably has a depth at least equal to the depth of the corresponding bottom wall.

The first and second equipment supporting sections are preferably fabricated from at least one of plastic, wood, metal.

The present invention also comprises, in an alternative embodiment, a modular portable equipment rack, for supporting and organizing equipment, particularly sports equipment. The modular portable equipment rack comprises at least two modules releasably assembled to one another. Each module, in turn, comprises a top wall, a bottom wall vertically spaced from the top wall, a rear wall extending between the top and bottom walls and connected to rear edges thereof, and first and second opposed end walls extending between the top and bottom walls, and connected to end edges thereof and to end edges of the rear wall. Cooperating structures are disposed in the first and second opposed end walls, operably configured to engage one another such that a second end wall of a first module may be disposed adjacent to and releasably engaged with, in a mutually supporting manner, a first end wall of a second module, so as to form an integrated equipment rack.

At least one of the modules further has at least one handle receiving structure disposed along a front edge region of the bottom wall thereof, the bottom wall of the at least one module further having an equipment receiving surface disposed between the handle receiving structure, and the rear edge of the bottom wall of the at least one module.

In the modular equipment rack, the cooperating structures disposed in the first and second opposed end walls preferably comprise a tongue structure disposed on each first end wall; and a groove structure disposed in each second end wall and operably configured to slidably and releasably receive a tongue structure from another like module.

The at least one handle receiving structure preferably comprises a baseball bat handle receiving notch formed in a front edge region of the bottom wall of the at least one module, the equipment receiving surface being disposed between an innermost extremity of the bat handle receiving notch and the rear edges of the bottom wall. Alternatively, the at least one handle receiving structure comprises at least one resilient biased structure, disposed along the front edge region of the bottom wall at least one module, and operably configured to resistively yield and resiliently, yet releasably retain, a sports equipment handle, when the sports equipment handle is forcibly inserted into the at least one resilient biased structure.

In the modular equipment rack, a handle is preferably disposed on an outer surface of at least one module, for facilitating carrying of the modular equipment rack.

The modular equipment rack preferably further comprises at least one hanging device for enabling the modular equipment rack to be suspended from a vertical support structure. A hook may be connected by an elongated flexible member, to an outer surface of at least one end wall of a module; and at least one second hook may be connected substantially directly to an outer surface of a rear wall of a module.

The top wall of at least one module preferably has a depth at least equal to the depth of the corresponding bottom wall. At least one module is fabricated from at least one of plastic, wood, metal.

The present invention also comprises an equipment rack module for forming a portable equipment rack, particularly for sports equipment. The module comprises a top wall, a bottom wall vertically spaced from the top wall, a rear wall extending between the top and bottom walls and connected to rear edges thereof, and first and second opposed end walls extending between the top and bottom walls, and connected to end edges thereof and to end edges of the rear wall. Cooperating structures are disposed in the first and second opposed end walls, operably configured to engage one another such that a second end wall of a first module may be disposed adjacent to and releasably engaged with, in a mutually supporting manner, a first end wall of a second module, so as to form an integrated equipment rack.

The equipment rack module preferably further comprises at least one handle receiving structure disposed along a front edge region of the bottom wall thereof, the bottom wall further having an equipment receiving surface disposed between the handle receiving structure, and the rear edge of the bottom wall.

In the equipment rack module, the cooperating structures disposed in the first and second opposed end walls, comprise a tongue structure disposed on each first end wall; and a groove structure disposed in each second end wall and operably configured to slidably and releasably receive a tongue structure from another like module.

The at least one handle receiving structure in the module comprises a baseball bat handle receiving notch formed in a front edge region of the bottom wall of the at least one module, the equipment receiving surface being disposed between an innermost extremity of the bat handle receiving notch and the rear edges of the bottom wall. Alternatively, the at least one handle receiving structure comprises at least one resilient biased structure, disposed along the front edge region of the bottom wall at least one module, and operably configured to resistively yield and resiliently, yet releasably retain, a sports equipment handle, when the sports equipment handle is forcibly inserted into the at least one resilient biased structure.

The equipment rack module further comprises a handle disposed on an outer surface of at least one module, for facilitating carrying of the modular equipment rack.

The equipment rack module may further comprise at least one hanging device for enabling the equipment rack module to be suspended from a vertical support structure. The at least one hanging device may comprise a hook, connected by an elongated flexible member, to an outer surface of at least one end wall; and at least one second hook, connected substantially directly to an outer surface of the rear wall.

In the equipment rack module, the top wall of the module preferably has a depth at least equal to the depth of the corresponding bottom wall.

The module is preferably fabricated from at least one of plastic, wood, metal.

DETAILED DESCRIPTION OF THE INVENTION

Figure 1:
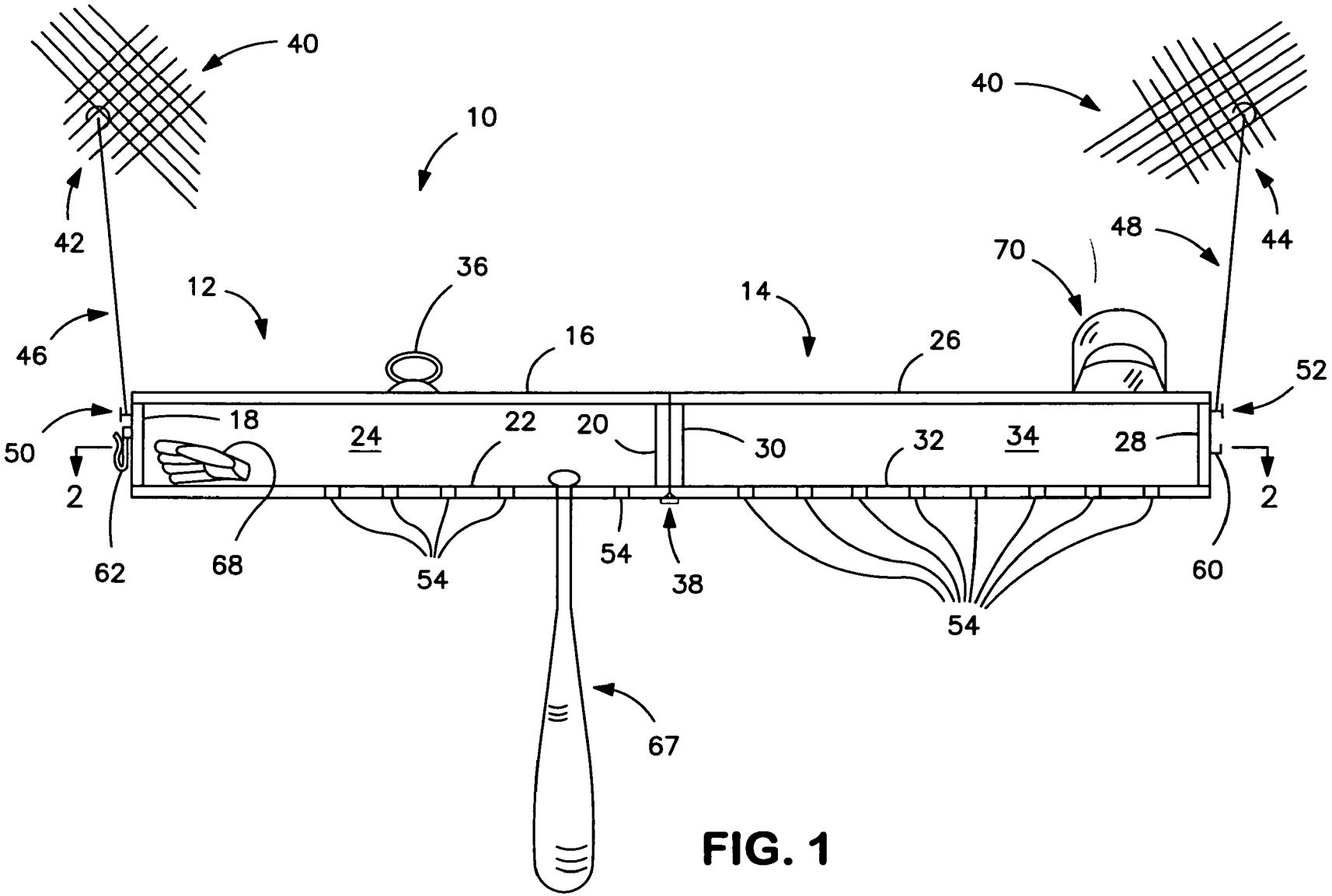
FIG. 1 is a front elevation of the equipment rack according to a preferred embodiment of the invention, shown in its opened, deployed configuration.

While this invention is susceptible of embodiment in many different forms, there is shown in the drawings and will be described in detail several specific embodiments, with the understanding that the present disclosure is to be considered an exemplification of the principles of the invention and is not intended to limit the invention to the embodiments illustrated.

Baseball equipment rack 10 as shown in FIGS. 1-8, may be fabricated from any suitable material, such as wood, plastic, metal, fiberglass, or other materials. Rack 10 preferably has two sections 12 and 14. Section 12 includes top wall 16, end walls 18 and 20, bottom wall 22, and rear wall 24, to define a mostly enclosed rectangular parallelepiped volume having an open front area. Section 14 includes top wall 26, end walls 28 and 30, bottom wall 32 and rear wall 34, to likewise define a mostly enclosed rectangular parallelepiped volume having an open front area. These various walls may be separately formed component parts that are later assembled and fastened together, such as by welding; glue; screw, nail, bolt or other fasteners. Alternatively, in the case of a molded, pressed, stamped or similarly formed unit, the walls may be monolithically formed together as a single component.

Figure 4:
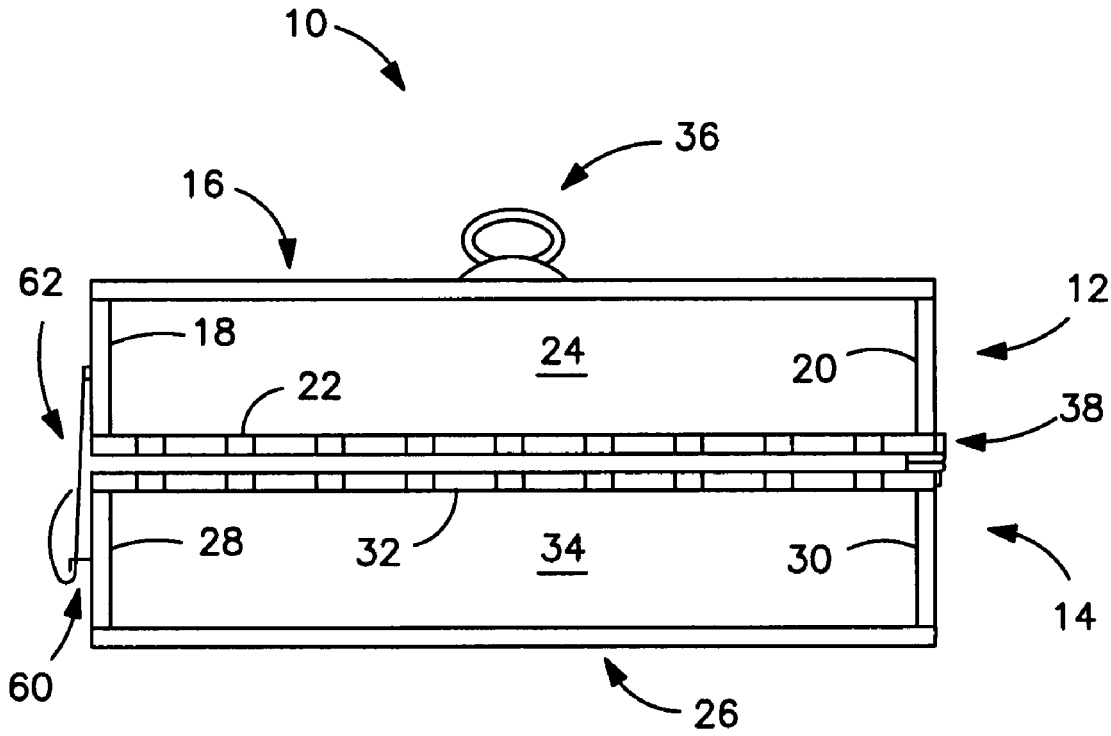
FIG. 4 is a front elevation of the equipment rack of FIGS. 1-3, shown in its folded configuration.
Figure 5:
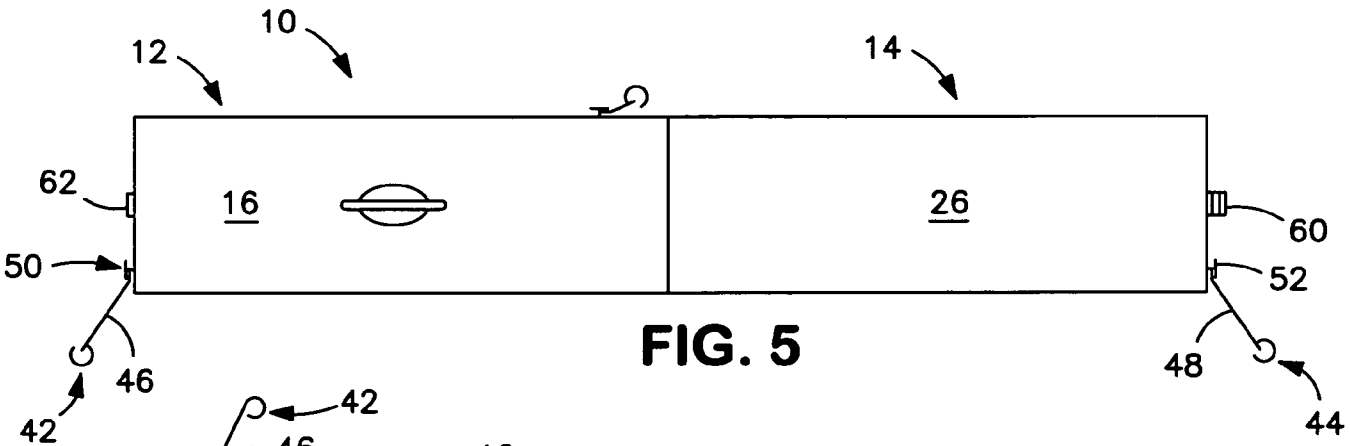
FIG. 5 is a top view of the equipment rack of FIGS. 1-4, shown in its open configuration.

Handle 36, which may be of any suitable configuration, is located in the upper surface of top wall 16. Bottom walls 22 and 32 are joined together at their inboard adjacent edges by a hinge 38, which may be a piano-style hinge, or any other suitable hinge device. Although hinge 38 is shown as projecting below the bottom surfaces of bottom walls 22 and 32, in alternative embodiments of the invention, the wings of the hinge may be mortised into the bottom surfaces of bottom walls 22, 32, so that when baseball equipment rack 10 is folded, as shown in FIG. 4, bottom walls 22, 32 will be juxtaposed closely to one another, or even touching, so as to provide a more compact construction. While one long hinge is illustrated, it is to be understood that hinge 38 may not extend the entire or even most of the depth of the bottom wall end edges. Furthermore, more than one hinge structure may be provided, one in front of the other.

Baseball equipment rack 10 is configured to be suspended from a vertically extending support surface, such as a chain-link backstop 40 (shown in fragments in FIG. 1), as are commonly found on baseball diamonds. To that end, hooks 42, 44 are joined by cables 46, 48, fastened at their other ends, e.g., by eyelet and bolt or screw (or other fastener) combinations, 50, 52, to end walls 18, 28, respectively. Hooks 42, 44 may be of any suitable configuration and as such are illustrated only schematically, as being readily understood by one of ordinary skill in the art, having the present disclosure before them. Likewise, cables 46, 48 may be of any suitable material and configuration, and may be substituted by rope, string, synthetic line, or chain, etc. In addition, a third hook 49 is affixed to one of rear walls 22, 32 (wall 22 is shown in the present application in FIGS. 3, 5, 7 and 8), which is, preferably directly affixed, not using any kind of cable or tether, to chain-link backstop 40, to prevent baseball equipment rack 10 from pivoting forward under the weight of the baseball bats, and to provide stability generally.

Along the front edges of each of bottom walls 22, 32, are formed a series of rearwardly receding notches 54, each of which preferably has a width which is slightly greater than the diameter of the handle of a baseball/softball bat 67, but less than the diameter of a knob on the handle end of a baseball/softball bat, as shown in FIG. 1. While in the embodiment shown in FIGS. 1-8, there are eight notches 54 in bottom wall 32 and six notches 54 in bottom wall 22, it is to be understood that greater or lesser numbers of notches (so long as at least some notches are provided) may be provided as desired, and equal numbers or different numbers may be provided in the respective sections 10, 12, as desired, without departing from the scope of the invention.

Figure 2:
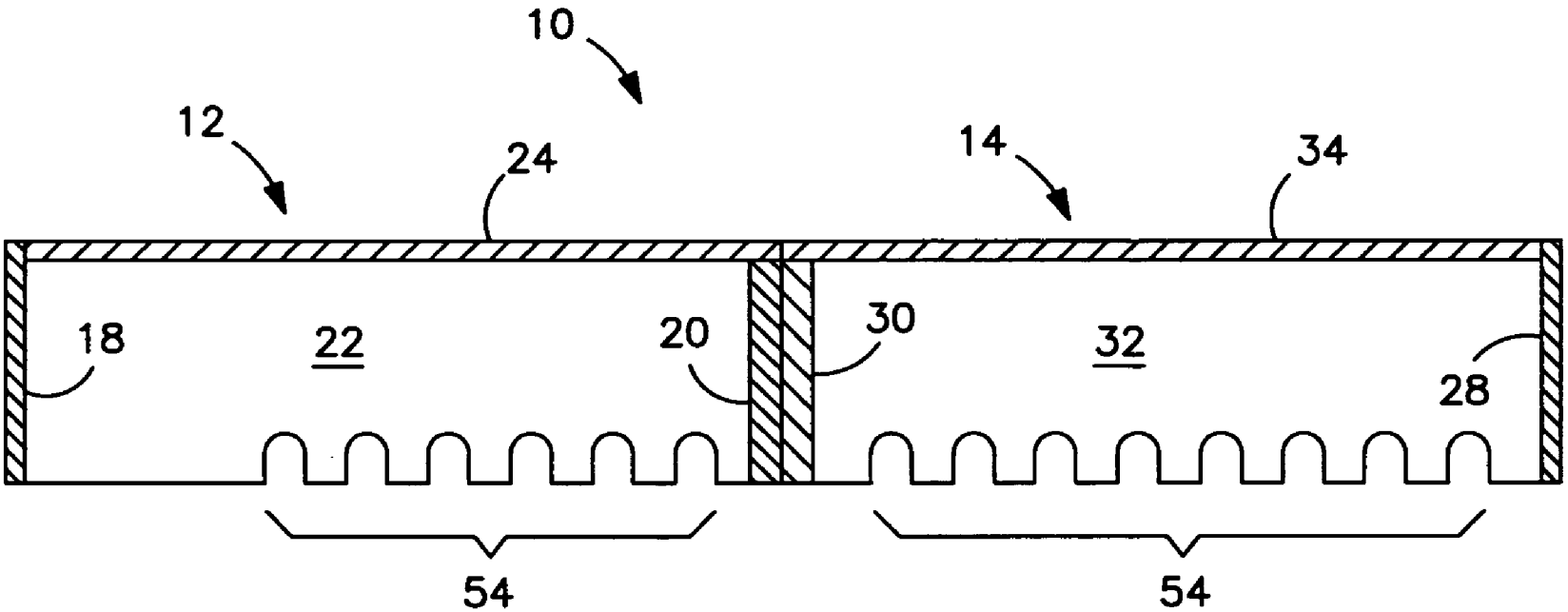
FIG. 2 is a top sectional view of the equipment rack of FIG. 1, taken along line 2-2 of FIG. 1.
Figure 3:
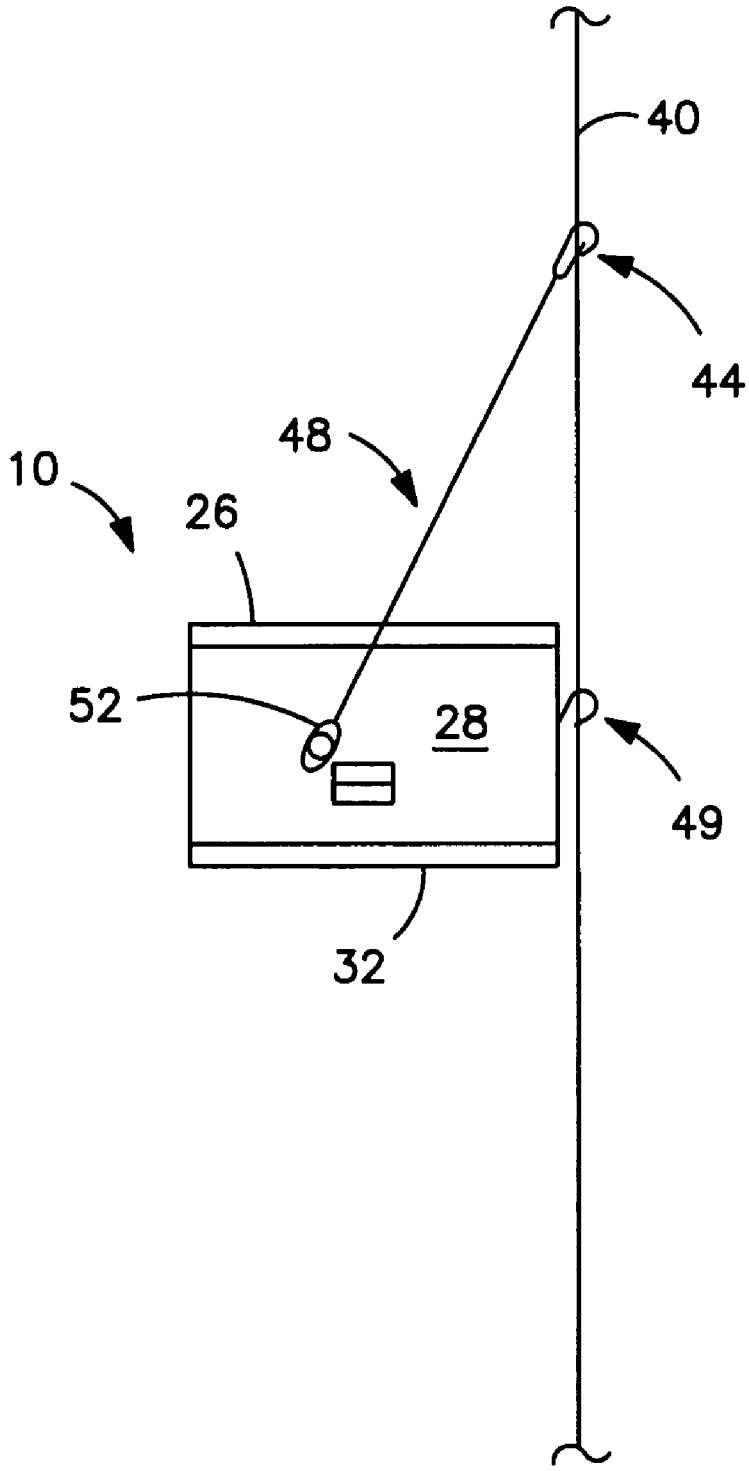
FIG. 3 is a side elevation of the equipment rack of FIGS. 1 and 2.
Figure 6:
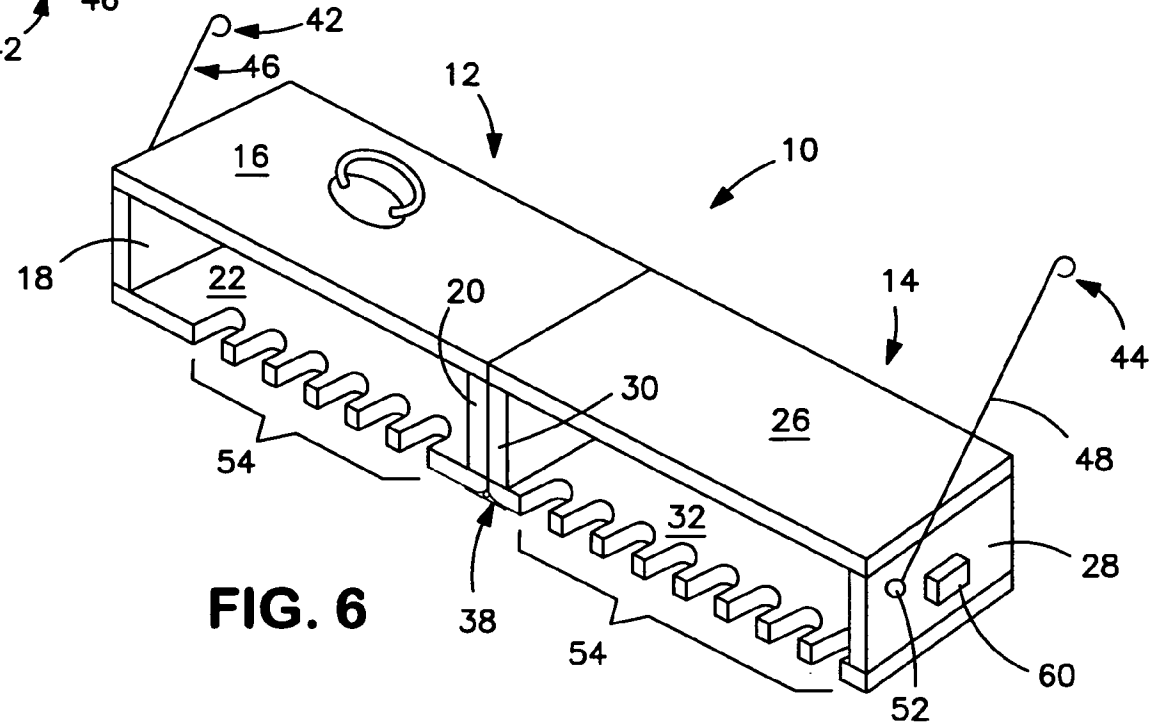
FIG. 6 is a perspective view of the equipment rack of FIGS. 1-5, shown in its open configuration.
Figure 7:
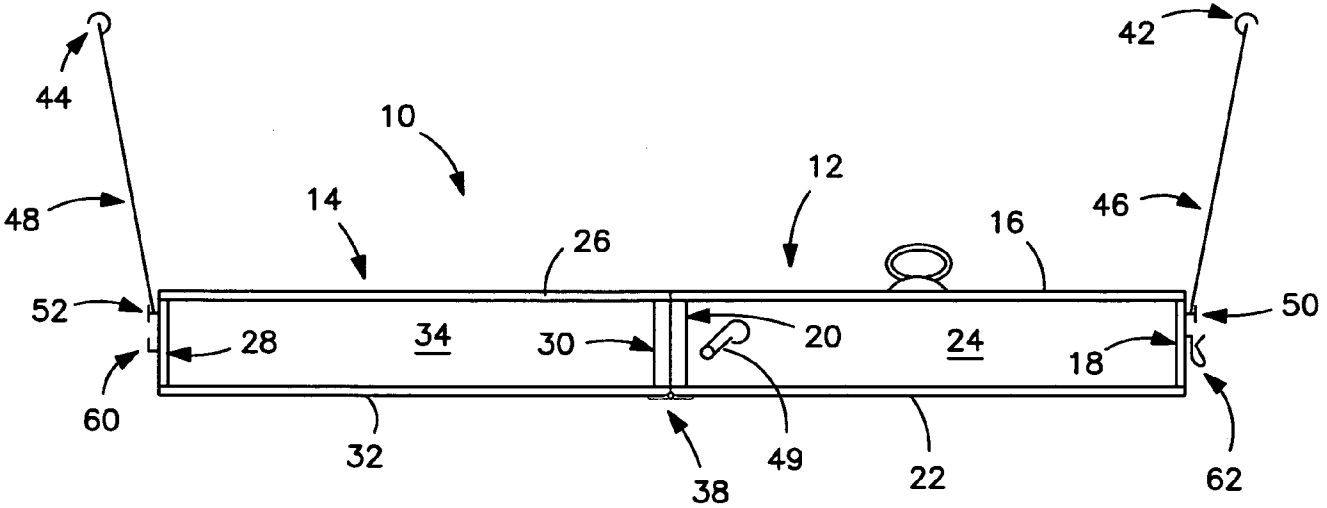
FIG. 7 is a rear view of the equipment rack of FIGS. 1-6, shown in its open configuration.
Figure 8:
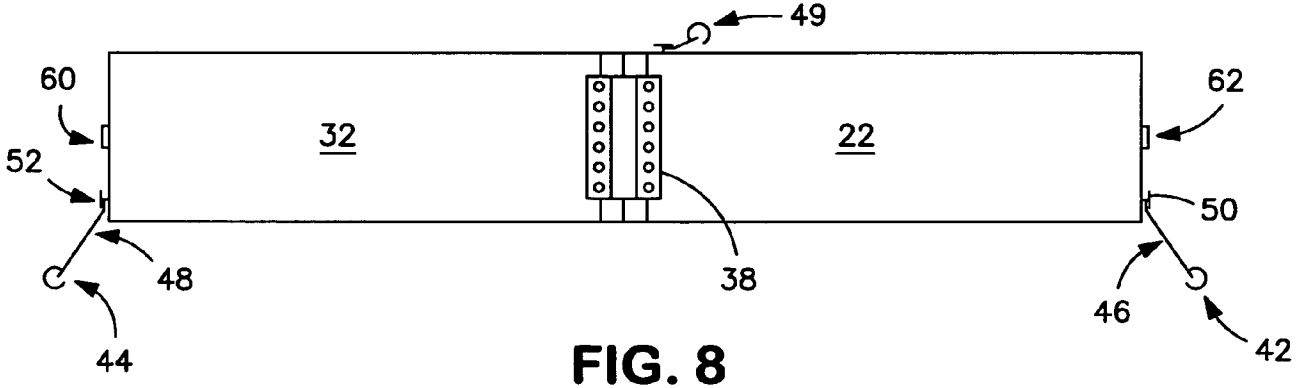
FIG. 8 is a bottom view of the equipment rack of FIGS. 1-7, shown in its open configuration.

Notches 54 preferably extend rearwardly into bottom walls 22, 32 a distance of several bat handle diameters, as shown in FIGS. 2 and 6. Depending upon the actual depth of bottom walls 22, 32, notches 54 should extend preferably from approximately one-quarter to one-third of the depth of bottom walls 22, 32, although a greater depth, up to about one-half of the depth, or a lesser depth (deep enough at least that the bat handles will be securely supported) may be used. Bottom walls 22, 32 should have sufficient depth and there should be sufficient spacing between top walls 16, 26 and bottom walls 22, 32, to enable articles, such as gloves 68, balls, etc. to be stored between the bat handles and rear walls 24, 34, respectively. In a preferred embodiment of the invention, top walls 16, 26 will have the same depth as bottom walls 22, 32, to support for example, helmets 70.

In alternative embodiments of the invention, the rounded interior ends of notches 54 may be surrounded by slight depressions (not shown) to help "seat" the bat handle knobs, to prevent inadvertent or unintended falling out of the handles from rack 10. Likewise, depressions or grooves may be provided in the upper surfaces of top walls 16, 26 and/or bottom walls 22, 32 (not shown) for providing stabilized location of balls, helmets, etc.

Figure 1A:
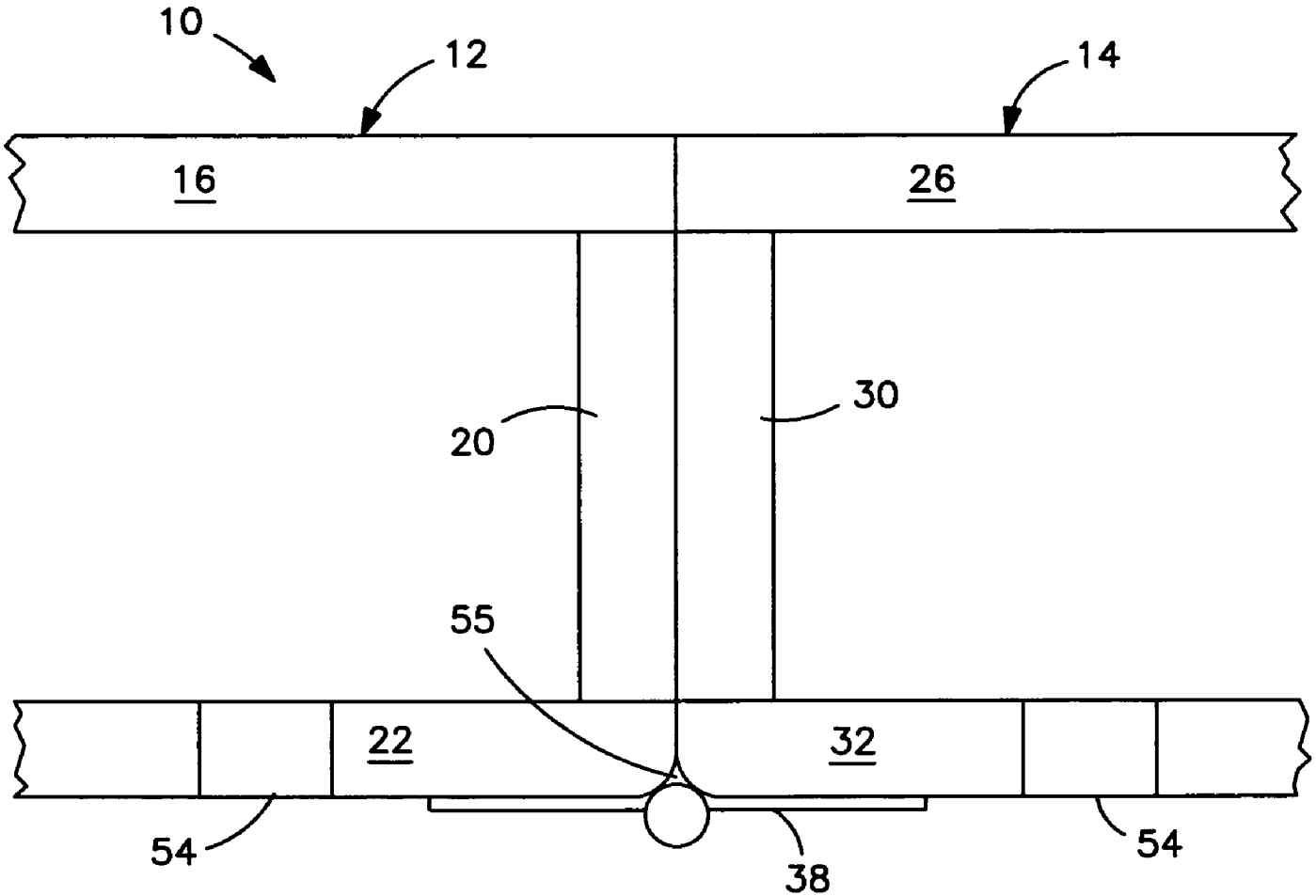
FIG. 1A is an enlarged, fragmentary front elevation of the equipment rack of FIG. 1.

Hinge 38 is advantageously situated between and connecting bottom walls 22, 32, so that the weight of baseball equipment rack 10, together with the combined weight of any articles thereon, tends to push down, causing sections 12 and 14 to be prompted to rotate upwardly toward one another about hinge 38. Preferably, the bottom interior corners of sections 12, 14, are provided with a substantial rounding radius (e.g., on the order of 0.5 inches), which provides a notch 55 (see FIG. 1A), into which the pin portion of hinge 38 (like a standard piano hinge) is received. This enables the interior ends of sections 12, 14 to be fitted close together, with essentially no gap, so that when baseball equipment rack 10 is deployed as shown in FIGS. 1, 5-8, top walls 16, 26, and bottom walls 22, 32 are substantially coplanar and not inclined toward one another. In alternative constructions, if a gap is present, this can be accommodated by the placement of a stop member, at the top edges of the inner ends, to hold the sections in such a position that the two sections are horizontal and level.

Baseball equipment rack 10 is provided with a latching device, including hook 60, and hasp 62, which may be of any suitable conventional construction. When the use of the baseball equipment rack 10 has been completed, the equipment is removed, and hooks 42, 44 and 49 are disconnected from chain-link backstop 40. The fasteners 50, 52 may themselves be separated from end walls 18, 28 if desired (as shown in FIG. 4), so that cables 46, 48 are not loosely hanging. Alternatively they may be left in place. In either mode, section 14 is folded up under section 12, and hook 60 and hasp 62 are engaged, locking section 14 in position under section 12, as shown in FIG. 4. Handle 36, which may be of any suitable configuration, is attached to the upper surface of top wall 16, to permit ready carrying of baseball equipment rack 10, in its stowed configuration.

Figure 9:
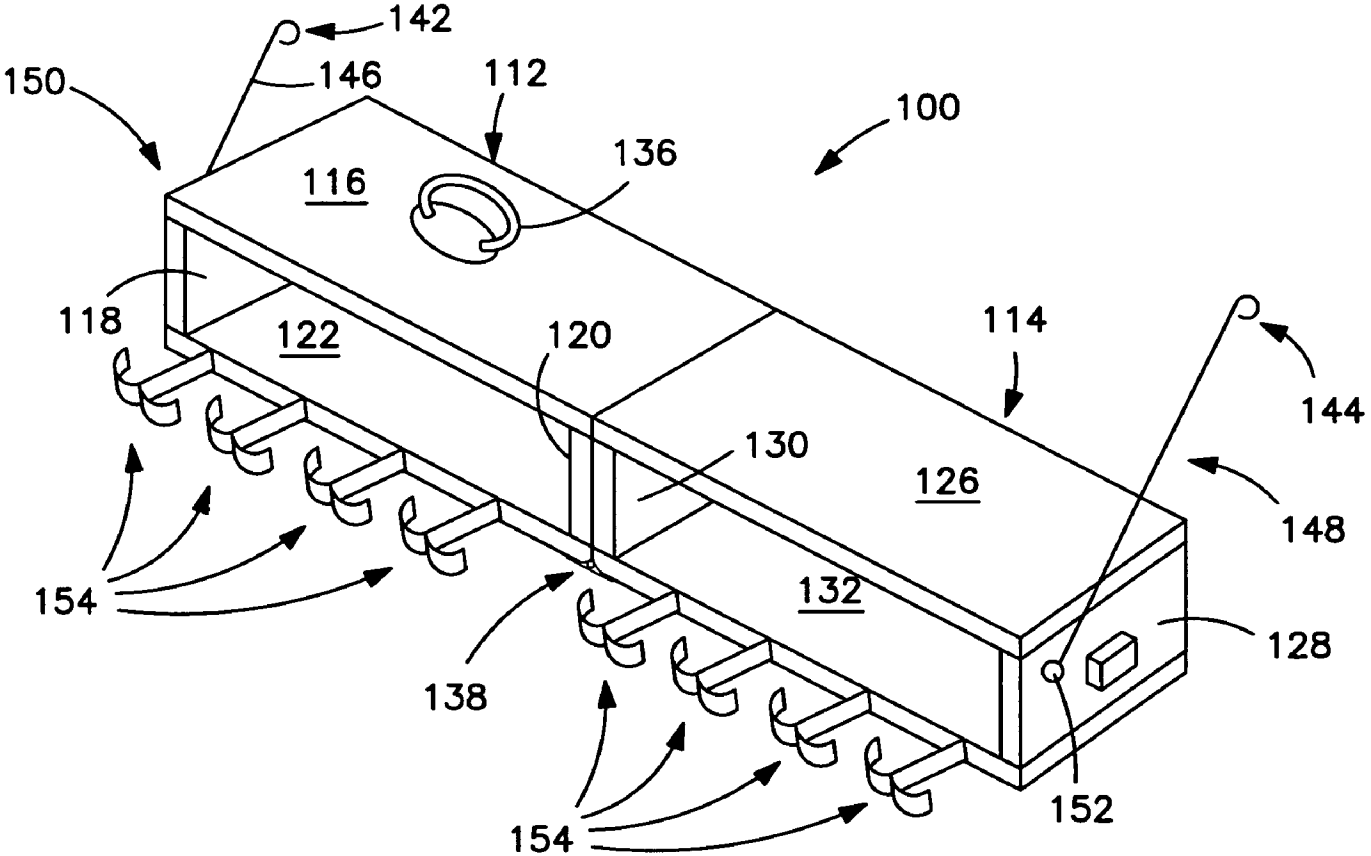
FIG. 9 is a perspective view of an alternative embodiment of the invention, where the notches for holding baseball bats have been replaced by clips for holding other articles, such as hockey sticks.
Figure 10:
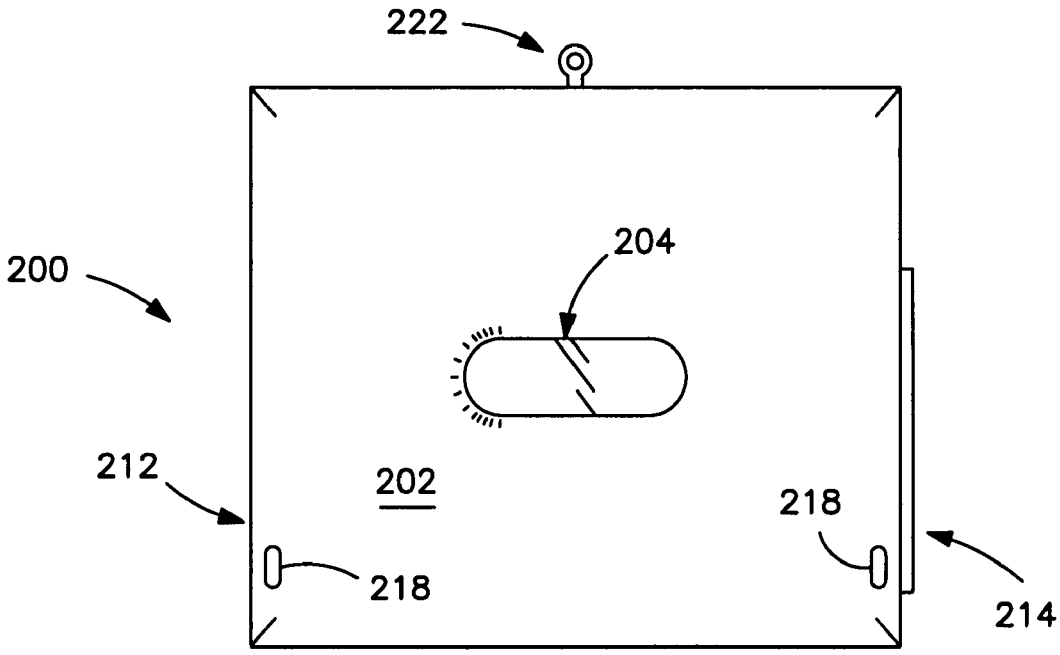
FIG. 10 is a top plan view of a module for an equipment rack according to an alternative embodiment of the invention.
Figure 11:
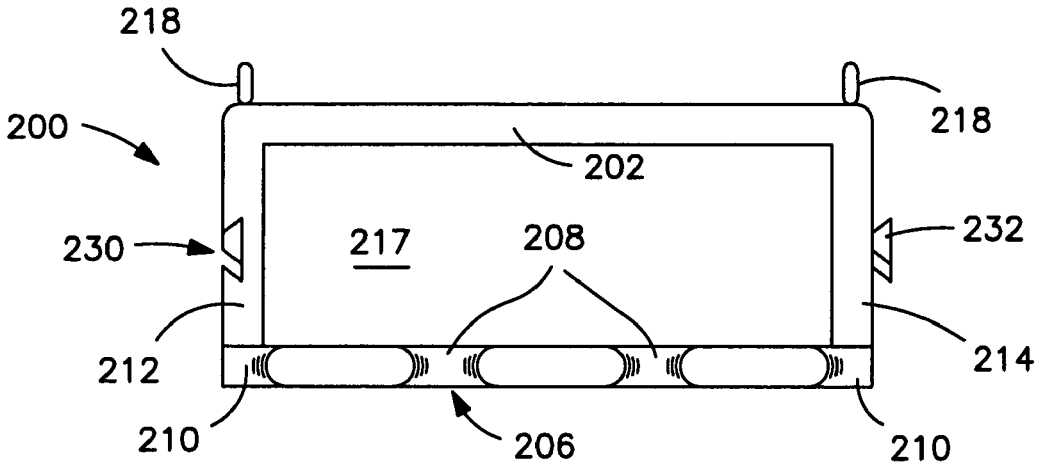
FIG. 11 is a front elevation of the module of FIG. 10.
Figure 12:
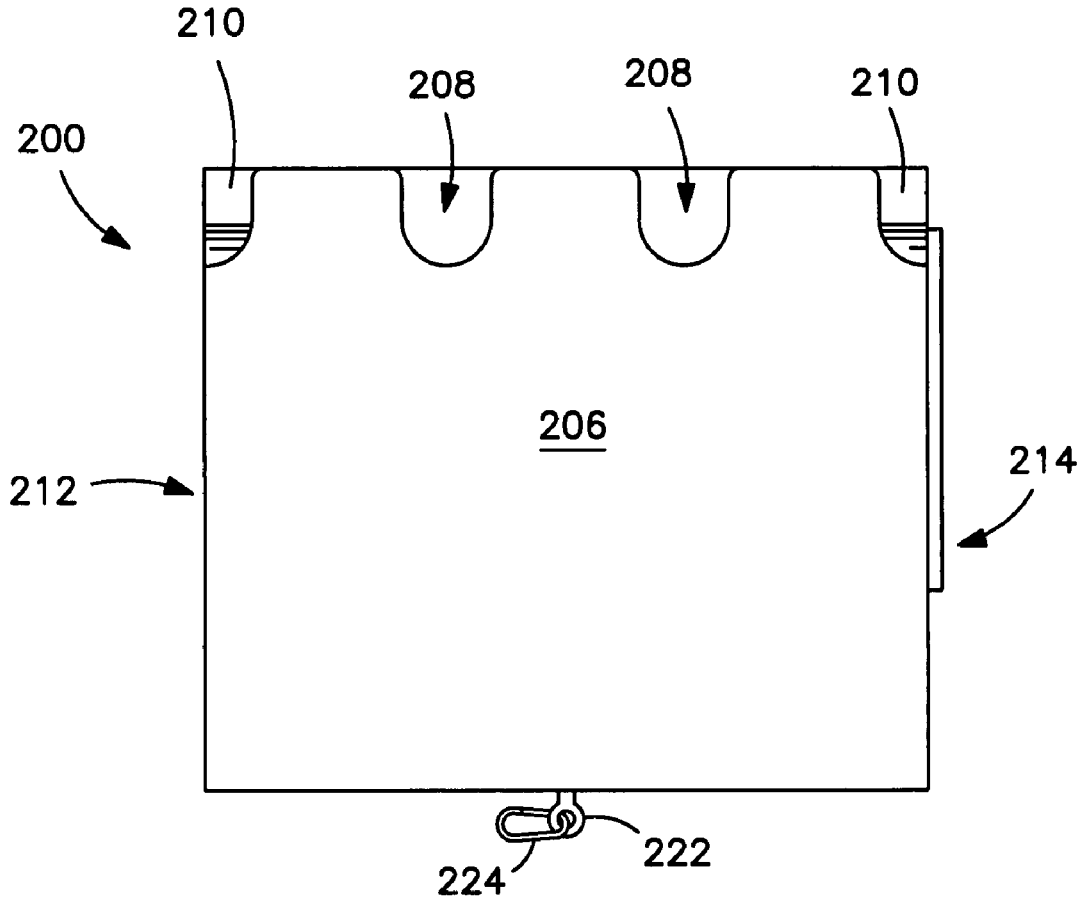
FIG. 12 is a bottom view of the module of FIGS. 10 and 11.

FIG. 9 is a perspective view of an alternative embodiment of the invention, where the notches for holding baseball bats have been replaced by clips for holding other articles, such as hockey sticks. Otherwise, the embodiment of FIG. 9 may be considered to be substantially identical in structure and function to the embodiment of FIGS. 1-8, and so only a single view is required to illustrate the salient structural differences between the two embodiments.

Alternative equipment rack 100 as shown in FIG. 9, may be fabricated from any suitable material, such as wood, plastic, metal, fiberglass, or other materials. Rack 100 preferably has two sections 112 and 114. Section 112 includes top wall 116, end walls 118 and 120, bottom wall 122, and a rear wall (not shown, but similar to that of the embodiment of FIGS. 1-8), to define a mostly enclosed rectangular parallelepiped volume having an open front area. Section 114 includes top wall 126, end walls 128 and 130, bottom wall 132 and a rear wall (not shown, but similar to that of the embodiment of FIGS. 1-8) to likewise define a mostly enclosed rectangular parallelepiped volume having an open front area. These various walls may be separately formed component parts that are later assembled and fastened together, such as by welding; glue; screw, nail, bolt or other fasteners. Alternatively, in the case of a molded, pressed, stamped or similarly formed unit, the walls may be monolithically formed together as a single component.

Handle 136, which may be of any suitable configuration, is located in the upper surface of top wall 116. Bottom walls 122 and 132 are joined together at their inboard adjacent edges by a hinge 138, which may be a piano-style hinge, or any other suitable hinge device. Although hinge 138 is shown as projecting below the bottom surfaces of bottom walls 122 and 132, in alternative embodiments of the invention, the wings of the hinge may be mortised into the bottom surfaces of bottom walls 122, 132, so that when alternative equipment rack 100 is folded, as baseball rack 10 was shown folded in FIG. 4, bottom walls 122, 132 will be juxtaposed closely to one another, or even touching, so as to provide a more compact construction. While one long hinge is illustrated, it is to be understood that hinge 138 may not extend the entire or even most of the depth of the bottom wall end edges. Furthermore, more than one hinge structure may be provided, one in front of the other.

Alternative equipment rack 100 is likewise configured to be suspended from a vertically extending support surface. To that end, hooks 142, 144 are joined by cables 146, 148, fastened at their other ends, e.g., by eyelet and bolt or screw (or other fastener) combinations, 150, 152, to end walls 118, 128, respectively. Hooks 142, 144 may be of any suitable configuration and as such are illustrated only schematically, as being readily understood by one of ordinary skill in the art, having the present disclosure before them. Likewise, cables 146, 148 may be of any suitable material and configuration, and may be substituted by rope, string, synthetic line, or chain, etc. In addition, a third hook (not shown) is affixed to one of the rear walls which is, preferably directly affixed, not using any kind of cable or tether, to the vertical support, to prevent alternative equipment rack 100 from pivoting forward under the weight of the baseball bats, and to provide stability generally.

Hinge 138 is advantageously situated between and connecting bottom walls 122, 132, so that the weight of alternative equipment rack 100, together with the combined weight of any articles thereon, tends to push down, causing sections 112 and 114 to be prompted to rotate upwardly toward one another about hinge 138. Preferably, the bottom interior corners of sections 112, 114, are provided with a substantial rounding radius (e.g., on the order of 0.5 inches), which provides a notch (like notch 55 in the embodiment of FIGS. 1-8), into which the pin portion of hinge 138 (like a standard piano hinge) is received. This enables the interior ends of sections 112, 114 to be fitted close together, with essentially no gap, so that when alternative equipment rack 100 is deployed as shown in FIG. 9, top walls 116, 126, and bottom walls 122, 132 are substantially coplanar and not inclined toward one another. In alternative constructions, if a gap is present, this can be accommodated by the placement of a stop member, at the top edges of the inner ends, to hold the sections in such a position that the two sections are horizontal and level.

Alternative equipment rack 100 may also be provided with a latching mechanism similar in function to that described with respect to the embodiment of FIGS. 1-8.

Instead of the notches 54, provided for baseball rack 10, alternative equipment rack 100 is provided with a plurality of spring clips 154, which may be of any suitable configuration, but which may be generally considered to be formed from two joined pieces (or one bent piece) of a resilient spring material (such as a flat strip or strips of metal). For example, a spring clip 154 may be formed so as to have two J-shaped sections placed back to back, so that when an article, such as a hockey stick handle, is thrust into the gap or crevice between the two sections, the spring resilience permits the two adjacent portions to yield sufficient to permit the handle to be pushed some distance between them. The spring force of the metal strips thus exerts a gripping force against the stick, tending to hold it in place and elevated, provided that the strips are fabricated with sufficient spring force.

FIGS. 10-13 illustrate an equipment rack module according to a further alternative embodiment of the invention, in which an equipment rack is formed by a succession of assembled modules 200. Each module 200, which, again, may be fabricated from wood, metal, plastic, etc., as desired, comprises a top wall 202 (including a oval finger-receiving opening 204), a bottom wall 206 (including a plurality of full notches or recesses 208 and two half-recesses 210 at the opposite ends thereof), end walls 212 and 214, and a rear wall 216, together defining an interior volume 217, for receiving gloves or other items. Eyelet bolts 218 are provided for attachment of cables 220 (see FIG. 13), to enable the rack to be hung from a backstop or other vertical support, in a manner similar to that described with respect to the embodiments discussed hereinabove. Eyelet bolt 222 is provided in rear wall 216, for receiving a clip 224 (FIGS. 12 and 13) or similar fastener, likewise for engaging the fence/backstop/vertical support, to provide support for preventing the module or rack from flipping around its transverse axis. Other forms of hardware and cable/wire/rope combinations may be employed, as desired, instead of the eyelet bolts and cables and clips shown in FIGS. 10-13, by one of ordinary skill in the art, having the present disclosure before them, without departing from the scope of the invention.

Figure 13:
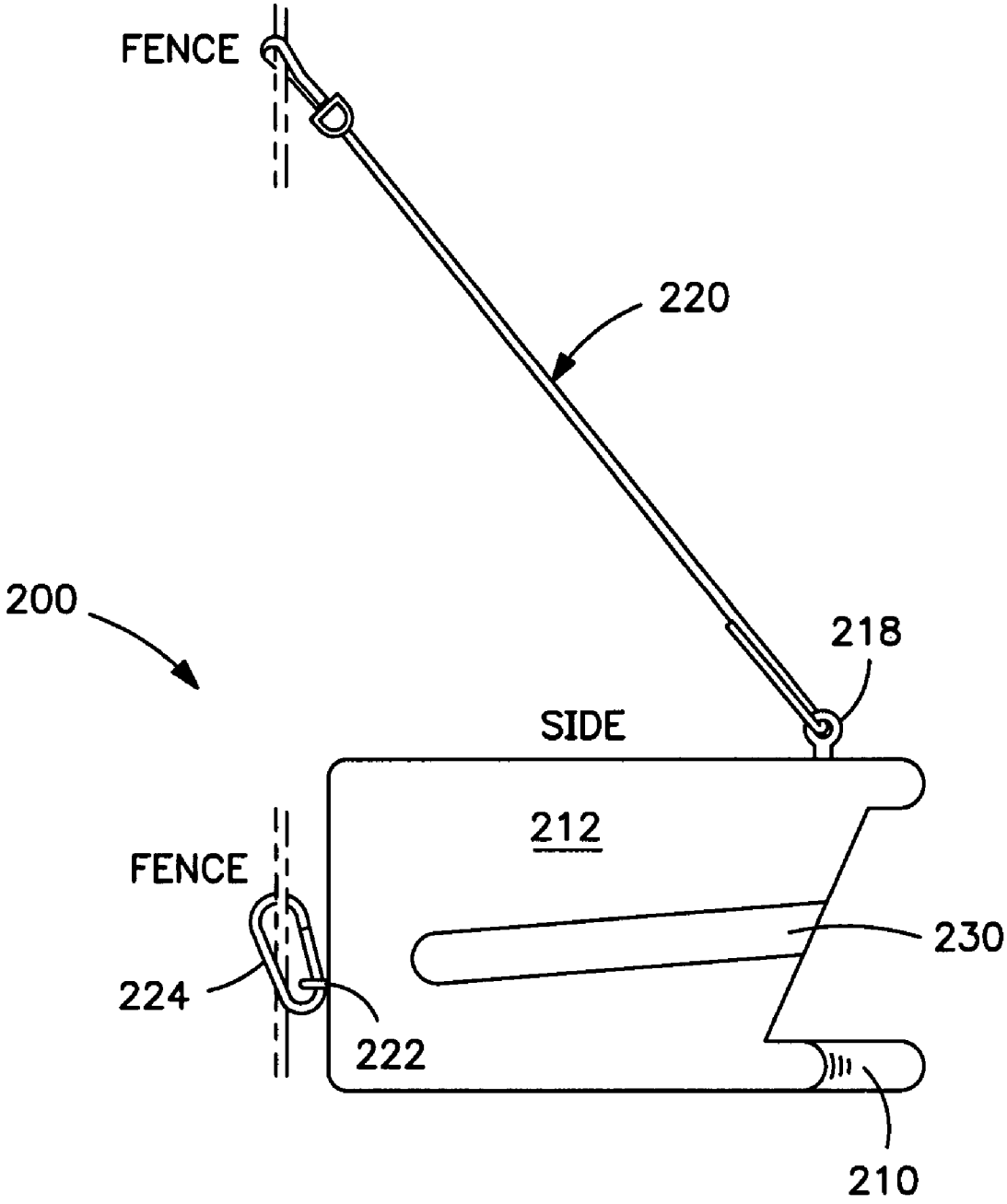
FIG. 13 is a side elevation of the module of FIGS. 10-12.

The end walls 212, 214 may be notched, so as to have inwardly inclining leading edges, as shown in FIG. 13, or they may be substantially rectangular, or have visibility apertures therein, or have such other shapes as may be desired, so long as the connecting structures, described herein, can be accommodated.

In order to permit an elongated rack to be formed from a plurality of modules 200, each module 200 may be provided with an elongated groove 230 in end wall 212, and a corresponding elongated tongue 232 in opposite end wall 214. Each tongue 232 and groove 230 may have a dovetail cross-sectional configuration, for enhanced module-to-module interfacing, and preferably, may be inclined downwardly toward rear wall 216, to provide a prompting against relative sliding and separation of adjacent modules. When two modules are assembled together, the half-recesses 210 that are positioned next to one another at the interface of the two modules will form a complete recess for receiving a bat handle.

Although a tongue and groove connection between adjacent modules is disclosed, alternative structures for consecutively connecting adjacent modules may be employed.

Although in one preferred embodiment, an equipment rack is formed from the assembly of two or more modules, it may be readily understood that each module may be employed and hung separately, if desired.

Module 200 may be suitably modified to incorporate handle retaining clips or similar resilient biased structures, as in the embodiment of FIG. 9.

The foregoing description and drawings merely explain and illustrate the invention, and the invention is not limited thereto, except as those skilled in the art who have the present disclosure before them will be able to make modifications and variations therein without departing from the scope of the invention.

The invention claimed is:

1. A portable equipment rack supporting and organizing sports equipment, comprising:

first and second equipment supporting sections, each equipment supporting section including a top wall, a bottom wall vertically spaced from the top wall, and a rear wall extending between the top and bottom walls, the top and bottom walls each having rear and end edges, respectively;

the rear wall having top, bottom and end edges; the rear wall further being connected to the rear edges of the top and bottom walls;

each equipment supporting section further including two end walls extending between the top and bottom walls and along the end edges of the rear wall and connected to respective ones of the end edges of the top and bottom walls;

at least one of the bottom walls of the first and second equipment supporting sections having at least one handle receiving structure disposed along a front edge region thereof, the at least one of the bottom walls further having an equipment receiving surface disposed between the handle receiving structure, and the rear edge of the at least one of the bottom walls;

wherein the end walls of each of said first and second equipment supporting sections are affixed to and support the respective top wall of each of said first and second equipment supporting sections, in vertically spaced relation to the respective bottom wall of each of said first and second equipment supporting sections;

a hinge, mounted to adjacent end edge regions of the respective bottom walls of the first and second equipment supporting sections, so that an end wall of each equipment supporting section is disposed proximate the hinge and the other end wall of each supporting section is disposed distal to the hinge, the hinge further having an axis of pivoting that extends parallel to adjacent ones of the end edges of the respective bottom walls of the first and second equipment supporting sections, for enabling the first and second equipment supporting sections to be pivoted between a deployed configuration, in which the first and second equipment supporting sections are disposed end-to-end, and a stowed configuration, in which the first and second equipment supporting sections are pivoted such that the respective bottom walls are juxtaposed parallel and adjacent one another, the positioning of the hinge being such that when the equipment rack is supported by its ends in the deployed configuration, the weight of the respective first and second equipment supporting sections will tend to prompt the first and second equipment supporting sections toward pivoting upwardly relative to one another, prompting adjacent ones of the end edges of the top walls toward one another, into abutment, without attachment therebetween, to maintain the equipment rack in its deployed configuration.

2. The equipment rack of claim 1, wherein the at least one handle receiving structure comprises a baseball bat handle receiving notch formed in a front edge region of the at least one bottom wall of the first and second equipment supporting sections, the equipment receiving surface being disposed between an innermost extremity of the bat handle receiving notch and the rear edge of the at least one bottom wall.

3. The equipment rack of claim 1, wherein the at least one handle receiving structure comprises at least one resilient biased structure, disposed along the front edge region of the at least one bottom wall of the first and second equipment supporting sections, and operably configured to resistively yield and resiliently, yet releasably retain, a sports equipment handle, when the sports equipment handle is forcibly inserted into the at least one resilient biased structure.

4. The equipment rack of claim 1, further comprising:

latching structures, disposed on the end walls of the first and second equipment supporting sections distal to the hinge, for releasably maintaining the first and second equipment supporting sections in the stowed configuration, for facilitating transportation of the equipment rack between uses.

5. The equipment rack of claim 1, further comprising:

a handle disposed on an outer surface of one of the top walls of the first and second equipment supporting sections, for facilitating carrying of the equipment rack when in its stowed configuration.

6. The equipment rack of claim 1, further comprising:

at least one hanging device for enabling the equipment rack to be suspended from a vertical support structure.

7. The equipment rack of claim 1, wherein the top wall of one of the first and second equipment supporting sections has a depth at least equal to the depth of the corresponding bottom wall.

8. The equipment rack of claim 1, wherein the first and second equipment supporting sections are fabricated from at least one of plastic, wood, metal.

* * * * *